US008991084B2

(12) United States Patent
Williams

(10) Patent No.: US 8,991,084 B2
(45) Date of Patent: Mar. 31, 2015

(54) APPARATUS AND METHODS FOR TRACKING AMMUNITION SUPPLY IN A MAGAZINE

(71) Applicant: Mark S. Williams, Burien, WA (US)

(72) Inventor: Mark S. Williams, Burien, WA (US)

( * ) Notice: Subject to any disclaimer, the term of this patent is extended or adjusted under 35 U.S.C. 154(b) by 0 days.

(21) Appl. No.: 14/188,336

(22) Filed: Feb. 24, 2014

(65) Prior Publication Data

US 2014/0250750 A1 Sep. 11, 2014

Related U.S. Application Data

(60) Provisional application No. 61/776,510, filed on Mar. 11, 2013.

(51) Int. Cl.
*F41A 9/53* (2006.01)
*F41A 9/62* (2006.01)

(52) U.S. Cl.
CPC ..... *F41A 9/62* (2013.01)
USPC ..... 42/1.02; 42/50; 42/49.01; 89/33.1

(58) Field of Classification Search
USPC ..... 42/1.02, 50, 49.01; 89/33.1
See application file for complete search history.

(56) References Cited

U.S. PATENT DOCUMENTS

| | | | | |
|---|---|---|---|---|
| 5,052,138 | A * | 10/1991 | Crain | 42/1.02 |
| 5,406,730 | A * | 4/1995 | Sayre | 42/1.02 |
| 6,094,850 | A * | 8/2000 | Villani | 42/1.02 |
| 8,109,023 | B2 * | 2/2012 | Pikielny | 42/1.01 |
| 2013/0227870 | A1 * | 9/2013 | Rendulic | 42/50 |

* cited by examiner

*Primary Examiner* — J. Woodrow Eldred
(74) *Attorney, Agent, or Firm* — Lowe Graham Jones PLLC

(57) ABSTRACT

A magazine is disclosed including a storage tube and a biasing member positioned within the storage tube. A strip engages the follower and extends toward a distal end of the storage tube. A display member is coupled to the strip and is viewable through the storage tube. The display member displays a state of the strip. The strip may be coupled to the follower and wrap around an axle or spool engaging an axle. The display member may be a window such that a portion of the strip around the axle is viewable. The strip may include visual indicators that are visible through the window and indicate a number of rounds within the magazine. A switch may be selectively activated to illuminate a portion of the strip viewable through the window.

20 Claims, 10 Drawing Sheets

APPARATUS AND METHODS FOR TRACKING AMMUNITION SUPPLY IN A MAGAZINE

PRIORITY CLAIM

This application claims the benefit of U.S. Provisional Application Ser. No. 61/776,510 filed Mar. 11, 2013, and entitled METHODS FOR TRACKING AMMUNITION SUPPLY IN A MAGAZINE, which is hereby incorporated herein by reference.

FIELD OF THE INVENTION

This invention relates to magazines for a firearm and, more particularly, to apparatus and methods for determining a number of rounds in a magazine.

BACKGROUND OF THE INVENTION

It can be extremely dangerous if a firearm runs out of ammunition in a critical situation for a soldier, law enforcement officer, hunter, or citizen required to use a firearm in self-defense. Typically, the only indication that a magazine is empty is the clicking of a firing pin in an empty chamber or the slider or bolt of the firearm locking in an open position. Of course, a user may simply count shots, but this is a difficult task to perform in a dangerous situation.

Most magazines do include some sort of indicator of rounds left. For example, a typical box magazine inserted within a grip of a pistol may include holes on the side of the magazine such that rounds within the magazine are visible when the magazine is removed. Numbers may even be printed or stamped next to each hole to indicate the number of rounds contained in the magazine up to that hole. However, these indicators are useful when loading but are not visible when the magazine is positioned within the firearm.

Accordingly, it would be an improvement in the art to provide a magazine enabling a user to determine a number of rounds therein while the magazine is inserted within a firearm.

SUMMARY OF THE INVENTION

In one aspect of the invention, a magazine includes a storage tube defining a proximal end and a distal end, the proximate end defining an opening for loading the magazine with rounds. A biasing member is positioned within the storage tube and has a first end and a second end, the first end being positioned closer to the proximal end than the second end. A display member is coupled to the biasing member and is viewable through the storage tube. The display member configured to display a state of the biasing member.

In some embodiments, a strip couples the biasing member to the display member. The display member may be a transparent member affixed to the storage tube and the strip may have position indicators defined thereon that are viewable through the transparent member from outside the storage tube. The strip may include an elastic material and have a rolled-up shape absent forces exerted on the strip.

In another aspect of the invention, a spool is rotatably coupled to the magazine having the biasing member positioned between the spool and the proximal end, at least a portion of the strip being wound around the spool. A return spring may have one end affixed to the spool and another other end fixed relative to the storage tube, the return spring being effective to urge the spool to wind the strip further around the spool. In some embodiments, a cap covers the distal end of the storage tube and the spool is rotatably mounted to the cap.

In another aspect of the invention, the display member is an arcuate window and protrudes from the distal end of the storage tube, the spool may be partially encircled by the arcuate window such that a portion of the strip wound onto the spool is visible through the arcuate window. In some embodiments, the strip has a plurality of numbers printed along the length thereof such that a number of the plurality of numbers that is visible through the arcuate window indicates a number of items positioned within the storage tube.

In another aspect of the invention, a switch is positioned between the cap and the biasing member such that urging the biasing member toward the distal end urges the switch against the cap and changes a state of the switch effective to cause the switch to couple a power source to a light emitting device. The light emitting device is positioned to illuminate a portion of the strip that is wound around the spool and visible through the display member.

A method of use for the magazine is also disclosed and claimed.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
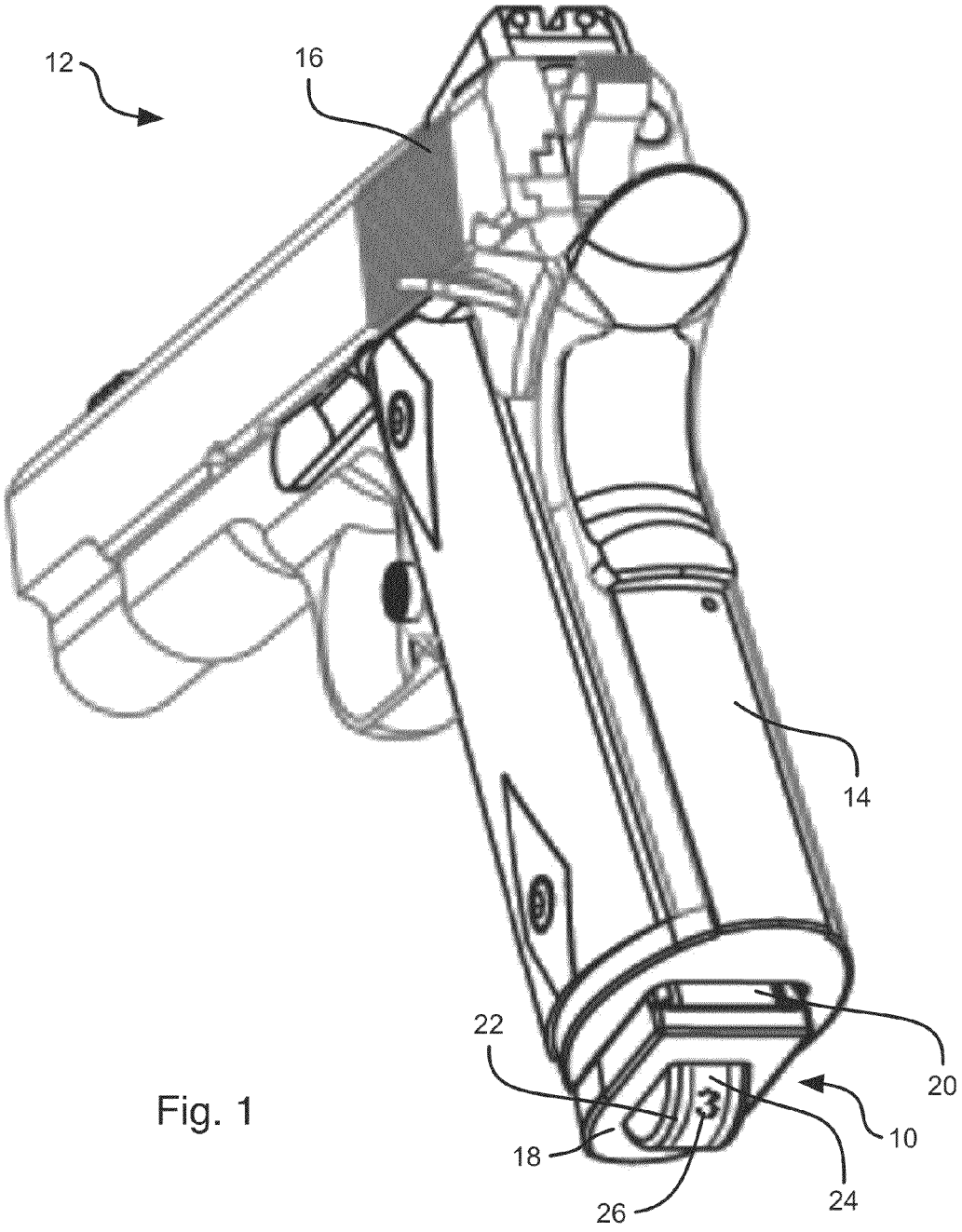
FIG. 1 is an isometric view of a firearm incorporating a magazine in accordance with an embodiment of the present invention.

Referring to FIG. 1, a magazine 10 may insert within a firearm 12. The illustrated firearm 12 is a pistol including a grip 14 for gripping by a user and an action 16 secured to the grip 14. The action 16 may include the elements of a firearm for firing a round including such elements as a firing pin, chamber, trigger mechanism, slide, barrel, etc. that are needed to implement an automatic, semi-automatic, single-action, double-action, single-shot or other type of firing mechanism for a firearm. The action 16 may be any action known in the art that may be used with a magazine, i.e. includes a feeding mechanism to feed a round from the magazine 10 into a chamber for firing in an automatic, semi-automatic, or single-shot fashion. The illustrated magazine 10 is a "box" magazine however the principles of the invention disclosed herein may also be applied to tube, drum, rotary, and other magazines.

The magazine 10 may include a storage tube 20 having a distal end covered by a cap 18. The cap 18 may be translucent or have a translucent window 22. The window 22 may simply be a hole passing through a wall of the cap 18 or be embodied as a hole passing through the cap 18 and having a piece of translucent material inserted therein.

A strip 24 may be disposed within the magazine 10 such that a portion thereof is visible through the window 22. The strip 24 may have printed, stamped, embossed, engraved, or otherwise defined thereon one or more visual indicators 26. The visual indicator 26 that is visible through the window 22 or at a defined position within the window 22 may indicate a number of rounds in the magazine 10 as described in greater detail herein below. The visual indicators may be numerals, symbols (a number of tick marks), or some other symbol indicating a number of rounds. The window 22 may include translucent material inserted therein that is contoured to magnify the visual indicators to enhance readability thereof, e.g. a lens.

Figure 2:
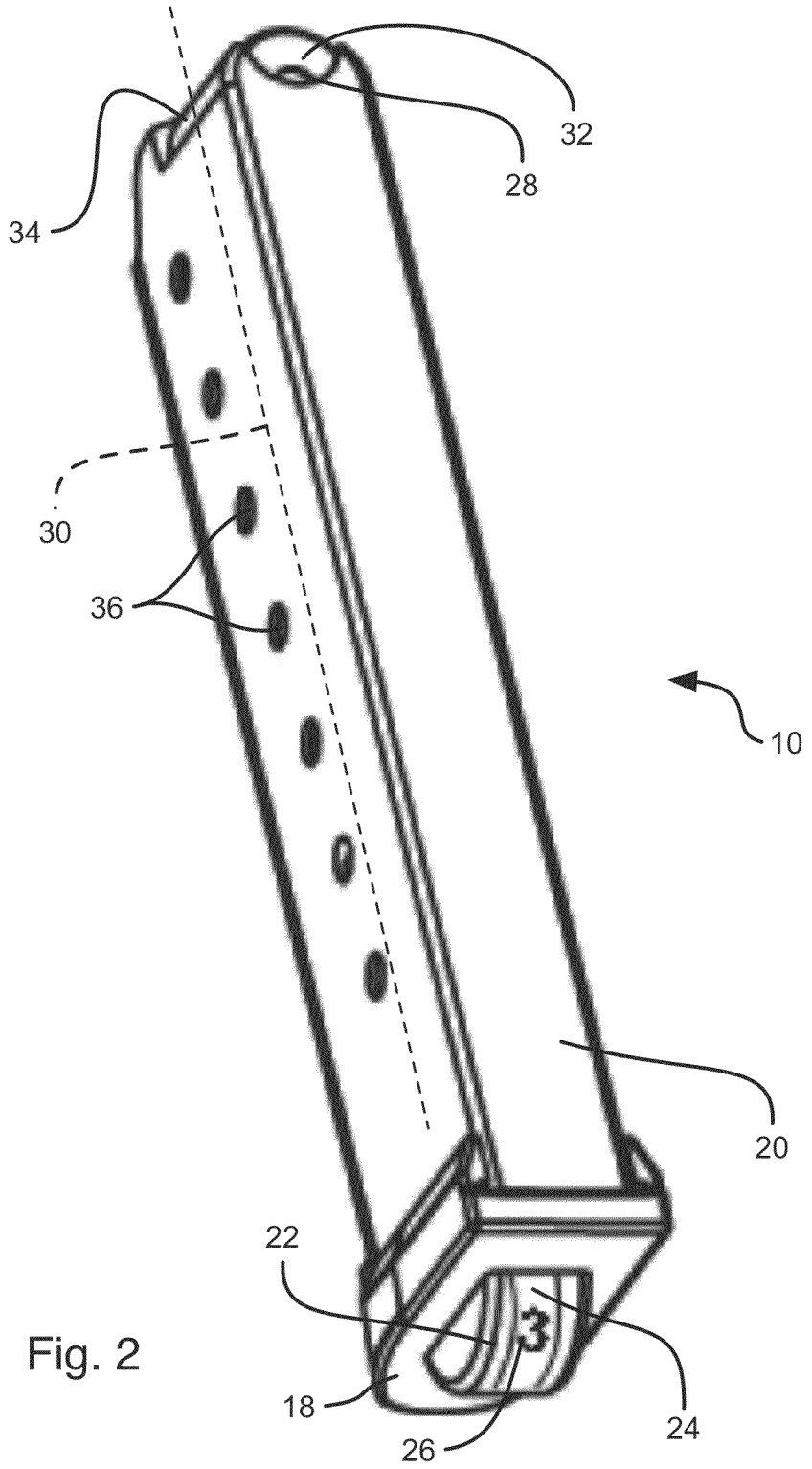
FIG. 2 is an isometric view of a magazine in accordance with an embodiment of the present invention.

Referring to FIG. 2, a proximal end of the storage tube 20 opposite the cap 18 may define an opening 28 through which rounds may be inserted in order to fill the magazine 10. As is apparent in FIG. 2, a major portion, e.g. 80% or more, of the length of the storage tube 20 has a constant cross-sectional shape along an axis 30. In the illustrated embodiment, this cross-sectional shape is a chamfered rectangle. In other embodiments, the cross sectional shape may be round or some other shape.

Rounds 32 may be inserted into the magazine 10 by feeding a round into the opening 28 under a lip 34 extending partially over the opening 28 as known in the art. The lip 34 may retain rounds within the storage tube 20. Rounds 32 may be inserted into the opening 28 having the axis of symmetry thereof oriented generally perpendicular (e.g. within +/−15 degrees of perpendicular) to the axis 30 as known in the art. Rounds 32 stored in the storage tube 20 may have the axis of symmetry thereof generally perpendicular to the axis 30. Where the magazine 10 is a tubular magazine, the axis along which the storage tube 20 has constant cross section is generally parallel (e.g. within +/−5 degrees of parallel) to the axes of symmetry of rounds 32 inserted therein. A lip 34 may retain rounds in the magazine as known in the art. In some embodiments, holes 36 perforating the storage tube and distributed along the axis 30 may enable a user to see rounds within the storage tube 20.

Figure 3:
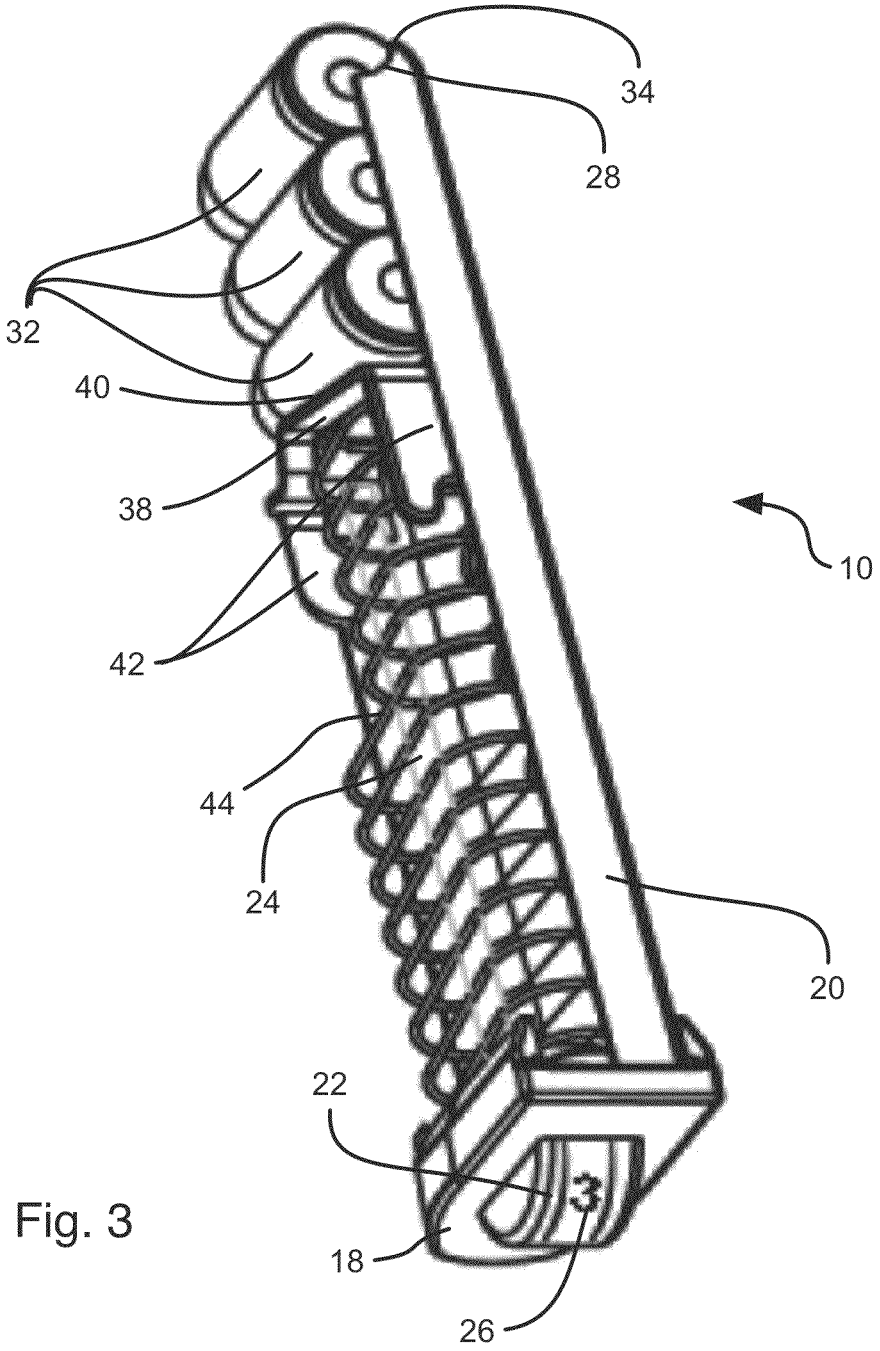
FIG. 3 is a partial cutaway view of a magazine in accordance with an embodiment of the present invention.

Referring to FIG. 3, a follower 38 may be slidably positioned within the storage tube 20. The follower 38 may define an upper surface 40 for engaging the rounds 32 and one or more walls 42 extending downwardly from the upper surface 40, e.g. away from the rounds 32. The walls 42 may resist twisting of the follower 38 within the storage tube 20. A follower spring 44 is positioned between the follower 38 and the cap 18. The spring 44 urges the follower 38 toward the opening 28 thereby urging rounds 32 out of the magazine 10 and/or against the lip 34.

Figure 4:
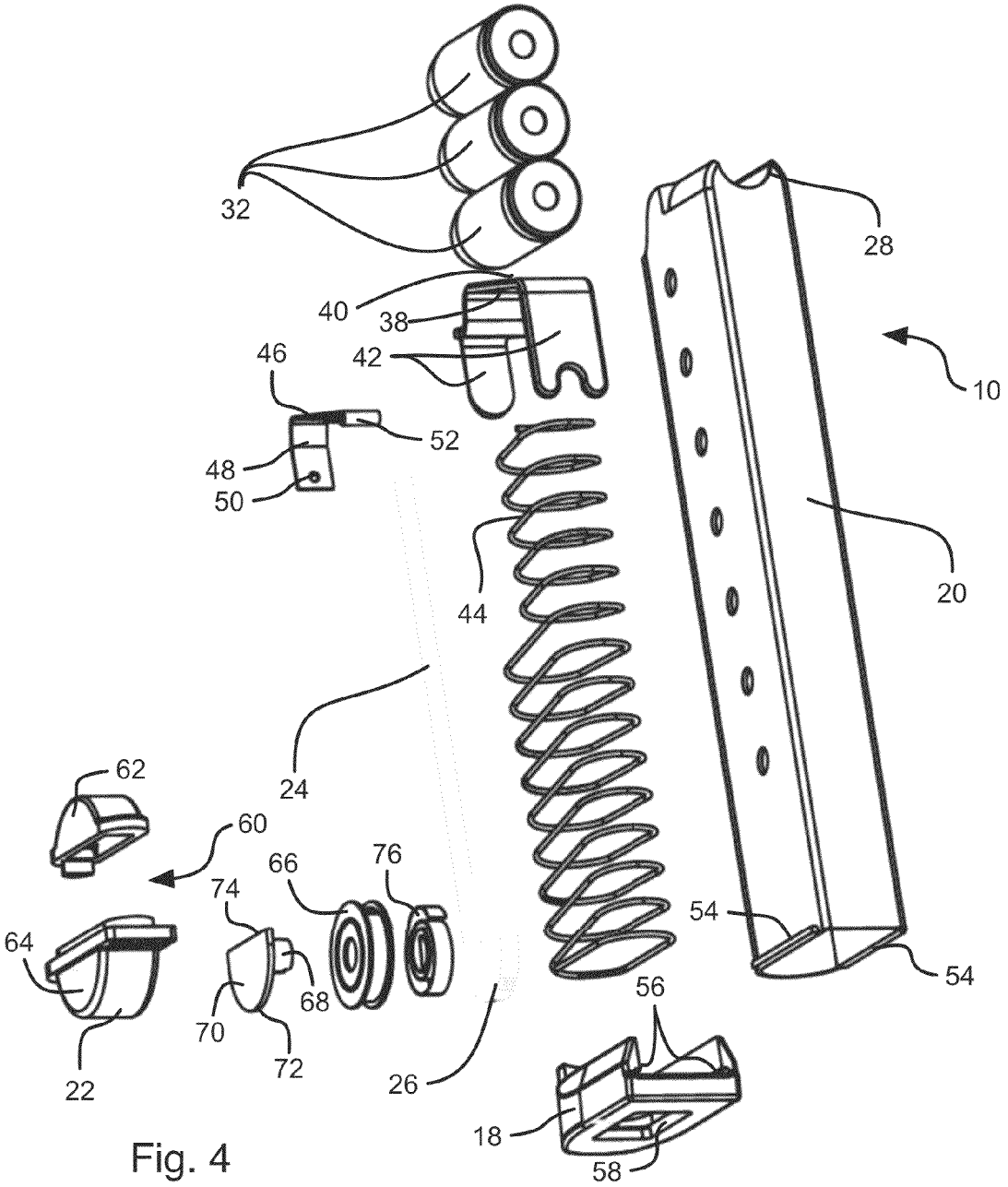
FIG. 4 is an exploded view of a magazine in accordance with an embodiment of the present invention.

Referring to FIG. 4, a clip 46 may be interposed between the follower 38 and the follower spring 44. The clip 46 may define a flange 48 having an aperture 50 defined therein. The aperture 50 may receive a fastener securing the strip 24 to the flange 48. The clip 46 may define another flange 52 opposite the flange 48 such that a portion of the follower spring 44 is positioned between the flanges 48, 52. In the illustrated embodiment, the flange 52 is folded inwardly or hooked toward the flange 48, such that a portion of the follower spring 44 is partially encircled by the flange 52. The strip 24 may also secure directly to the follower rather than by means of a clip 46 and the clip 46 may have any configuration for retaining the strip 24 with respect to the follower 38.

The cap 18 may be secured to the storage tube 20 by any means known in the art. For example, the cap 18 may be secured to the storage tube 20 by means of fasteners, adhesive, welds, or any other fastening means. In the illustrated embodiment, ridges 54 defined along a distal end of the storage tube 20 are received within slots 56 defined by the cap 18 such that the cap 18 may be slid over the end of the storage tube 20. The slots 56 may be sized such that the slots 56 grip the ridges 54 and no further fastening means are needed. Adhesive may further be used to secure the ridges 54 within the slots 56. A fastener may also engage the storage tube 20 and cap 18 in order to prevent disengagement of the ridges 54 from the slots 56.

The cap 18 may define an opening 58 for receiving a portion of a housing 60. Alternatively, the housing 60 may be an integral or monolithic part of the cap 18. The housing 60 may receive a portion of the strip 24 as it is wound, responsive to movement of the follower 38 toward the cap 18. In the illustrated embodiment, the housing 60 includes an upper housing portion 62 and a lower housing portion 64 that between them define a drum-shaped cavity with the boundary between the upper housing portion 62 and lower housing portion 64 being parallel to, and possibly intersected by, an axis of symmetry of the drum-shaped cavity. The axis of symmetry of the drum may be perpendicular to the axis 30 of the storage tube 20.

The window 22 may be defined on, or secured to, the lower housing portion 64 and the lower housing portion 64 may protrude through the opening 58 such that at least a portion of the window 22 is exposed through the opening 58. As is apparent, the window 22 may have an arcuate shape, such as a portion of a cylinder. The window 22 may define a portion of a cylindrical wall of the drum-shaped cavity.

The drum-shaped cavity may include therein an axle 68 parallel to, and possibly centered on, an axis of symmetry of the drum-shaped cavity defined by the upper and lower housing portions 62, 64. The axle 68 may insert within a spool 66 such that the spool is rotatable about the axle 68. In the illustrated embodiment, the axle 68 is secured to a planar locator plate 70 that maintains the axle 68 in a desired position within the drum-shaped cavity. In the illustrated embodiment, the locator plate 70 includes a rounded surface 72 sized to conform to an inner surface of the drum shaped cavity defined by the lower housing portion 64. The locator plate 70 may include a flat surface 74. The flat surface may abut a portion of the upper housing portion 62 and prevent rotation of the locator plate 70. Alternatively, the rounded surface 72 may engage a cylindrical surface within the upper housing portion 62 and the flat surface 74 abuts the lower housing portion 64.

In some embodiments, a spring 76 is coupled between the spool 66 and the axle 68 such that the spring is deformed as the spool 66 is rotated due to tension on the strip 24. The spring rotates the spool 66 when tension on the strip 24 is reduced. In the illustrated embodiment, the spring 76 is a constant-force spring wound around the axle 68 and having one end fixed relative to the axle and another end coupled to the spool 66. As known in the art, a constant force spring is a flat strip of elastic material, such as metal or resilient polymer, rolled into a coil.

In some embodiments, a perimeter of the spool 66 that is not covered by the strip 24, e.g. a rim on either side of the strip 24, may be marked with numerals or other symbols such that the position of the spool as viewable through the window 22 indicates a number of rounds in the magazine, rather than visual indicators 26 (FIG. 1) defined on the strip 24. In such embodiments, the strip 24 may be made arbitrarily thin since it does not need to be wide enough to have readable numerals or symbols printed thereon. The strip 24 may be a thin cable, wire, polymer filament, or the like.

Figure 5:
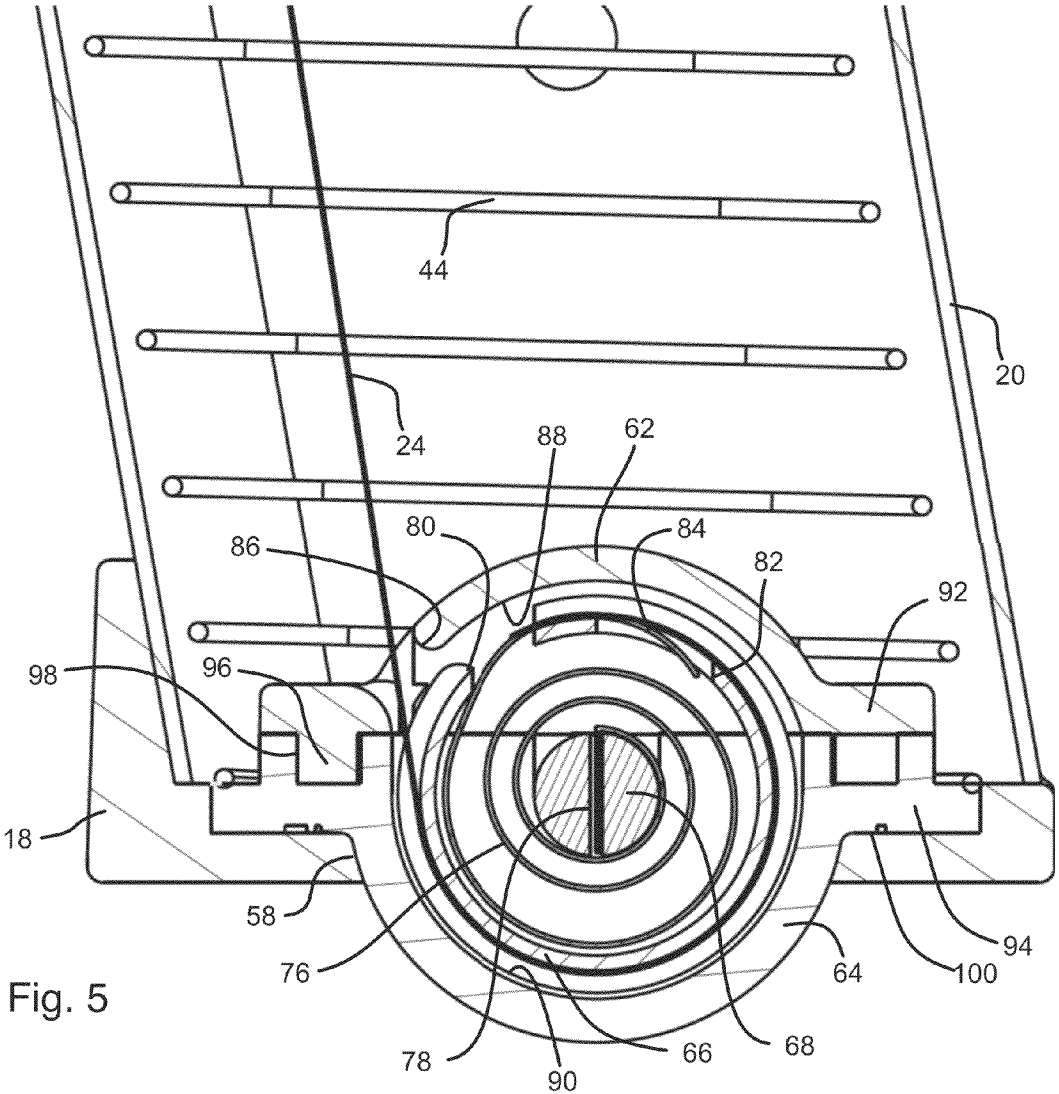
FIG. 5 is a partial cross-sectional view of a magazine in accordance with an embodiment of the present invention.

FIG. 5 illustrates the strip 24 wound around the outside of the spool 66 whereas the spring 76 is positioned within the spool 66. The axle 68 may define a slot 78 extending partially or completely through the axle 68 and an end of the spring 76 may be positioned within the slot 78 such that the end of the spring 76 is restrained from rotating. The axle 68 may be affixed to the lower housing portion 64 or prevented from rotating due to the locator plate 70.

The other end of the spring 76 may be coupled to the spool 66. For example, as shown in FIG. 5, the spring extends out of the spool 66 through opening 80 and then inserts back into the spool through opening 82 to affix an end portion 84 of the spring 76 to the spool 66. The friction between the spring 76 and the spool 66 may be sufficient to prevent removal of the end portion 84 from the openings 80, 82 due to forces exerted during expected operating conditions. In some embodiments, the end portion 84 of the spring 76 inserted through the opening 82 may be hooked or otherwise permanently deformed to further affix the spring 76 to the spool 66.

The upper housing portion 62 may define a slit 86 or other opening through which the strip 24 may pass. As shown, the slit 86 may be positioned on one side of the upper housing portion 62 and sized such that the strip 24 may pass through the slit 86 and around the spool 66 without contacting the sides of the slit 86 or being deformed by the slit 86.

As noted above, the upper housing portion 62 defines a cylindrical surface 88 and the lower housing portion 64 defines a cylindrical surface 90 that together form a drum-shaped cavity having a diameter large enough to received the spool 66 as well as allow for rotation of the spool when the strip 24 is wrapped around the spool a number of times, e.g. 5 to 10 times, without interference.

The upper housing portion 62 may define a flange 92 extending partially or completely around the drum-shaped cavity and the lower housing portion 64 may define a flange 94 extending partially or completely around the drum-shaped cavity. The flange 92 of the upper housing portion 62 may include a tab 98 and the flange 94 of the lower housing portion 94 may include a groove sized and positioned to receive the tab 98 in order to align the upper and lower housing portions 62, 64 and at least partially restrain relative movement therebetween. In the illustrated embodiment, the cap 18 defines a seat 100 or recessed portion 100 for receiving the flange 94. In some embodiments, the pressure of the follower spring on the upper housing portion 62, such has the flange 92, maintains the lower housing portion within the seat 100 and opening 58 in the cap 18 absent any other fasteners. This arrangement reduces the likelihood of damage to the lower housing portion 62, upper housing portion 64, and components mounted thereon inasmuch as an impact on the lower housing portion 64 will simply drive the lower housing portion 62 into the storage tube 20 against the biasing force of the follower spring 44.

Figure 6:
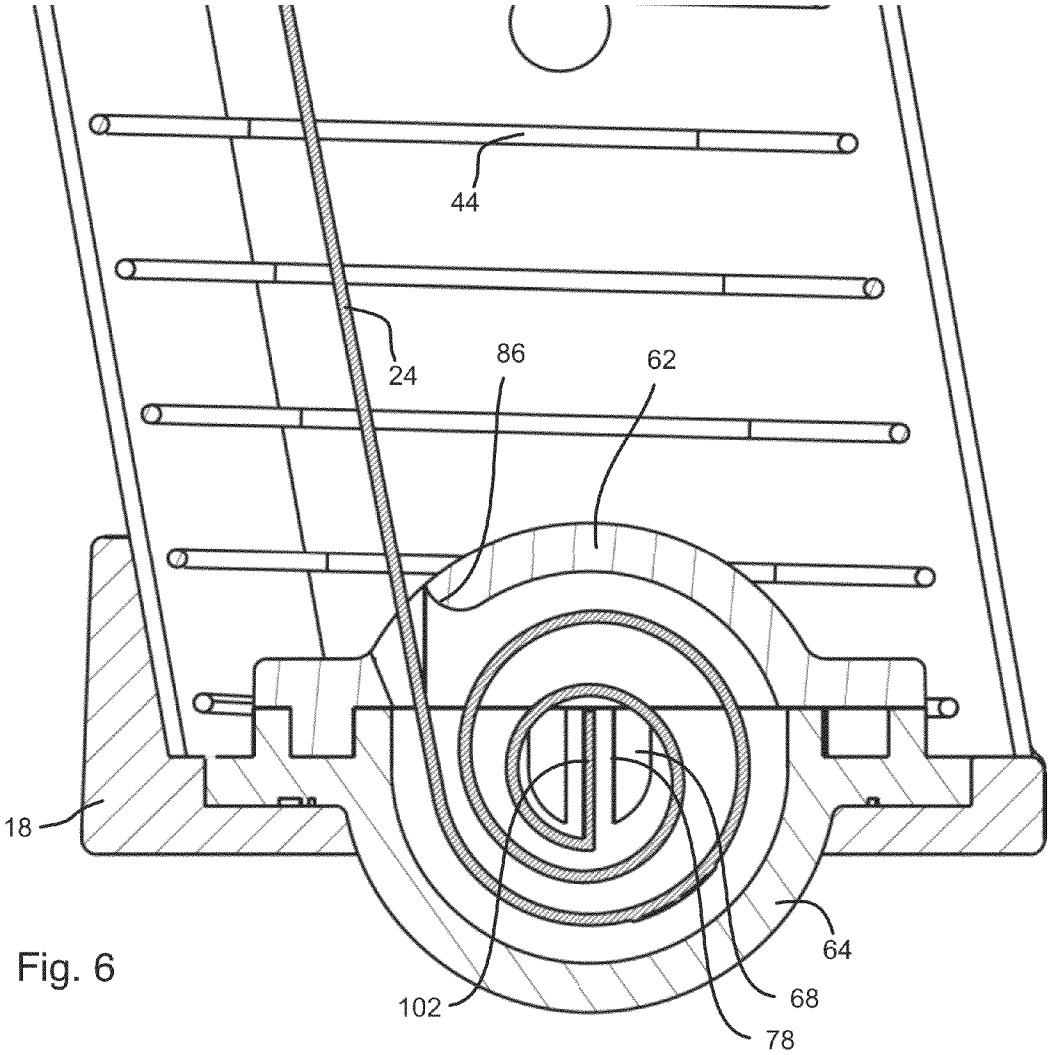
FIG. 6 is a partial cross-sectional view of an alternative embodiment of a magazine in accordance with an embodiment of the present invention.

Referring to FIG. 6, in some embodiments the spool 66 and spring 76 may be omitted. Instead, the strip 24 may itself be embodied as a constant force spring including a hooked or angled end portion 102 engaging the slot 78 of the axle 68. Accordingly, a restoration force generated by the strip 24 may urge the strip 24 to wind around the axle 68 responsive to compression and decompression of the follower spring 44. In the embodiments above, the strip 24 may also be embodied as a constant force spring, though the spring 76 assists in winding of the strip 24 around the spool 66. In some embodiments, the strip 24 may include two parts: a measuring portion that includes markings (text, symbols, etc.) indicating a number of rounds in the magazine and a spring portion embodied as a constant force spring. The measuring portion may secure at one end to the follower 44, such as by means of clip 46 (FIG. 4) and at an opposite end to the spring portion, the spring portion being wound around the axle 68 and engaging the slot 78 or otherwise affixed to the axle 68.

In some embodiments, the coiling of the portion of the strip 24 within the chamber defined by the upper and lower housing portions 62, 64 is sufficient to resist removal of the coiled portion from the drum-shaped chamber. In such embodiments, the axle 68 may be omitted and the strip 24 may coil and uncoil responsive to compression and expansion of the follower spring 44 without being restrained by the axle 68. In such embodiments, the opening 86 may be small enough to prevent the strip 24 from completely exiting the chamber responsive to expansion of the follower spring 44.

Figure 7:
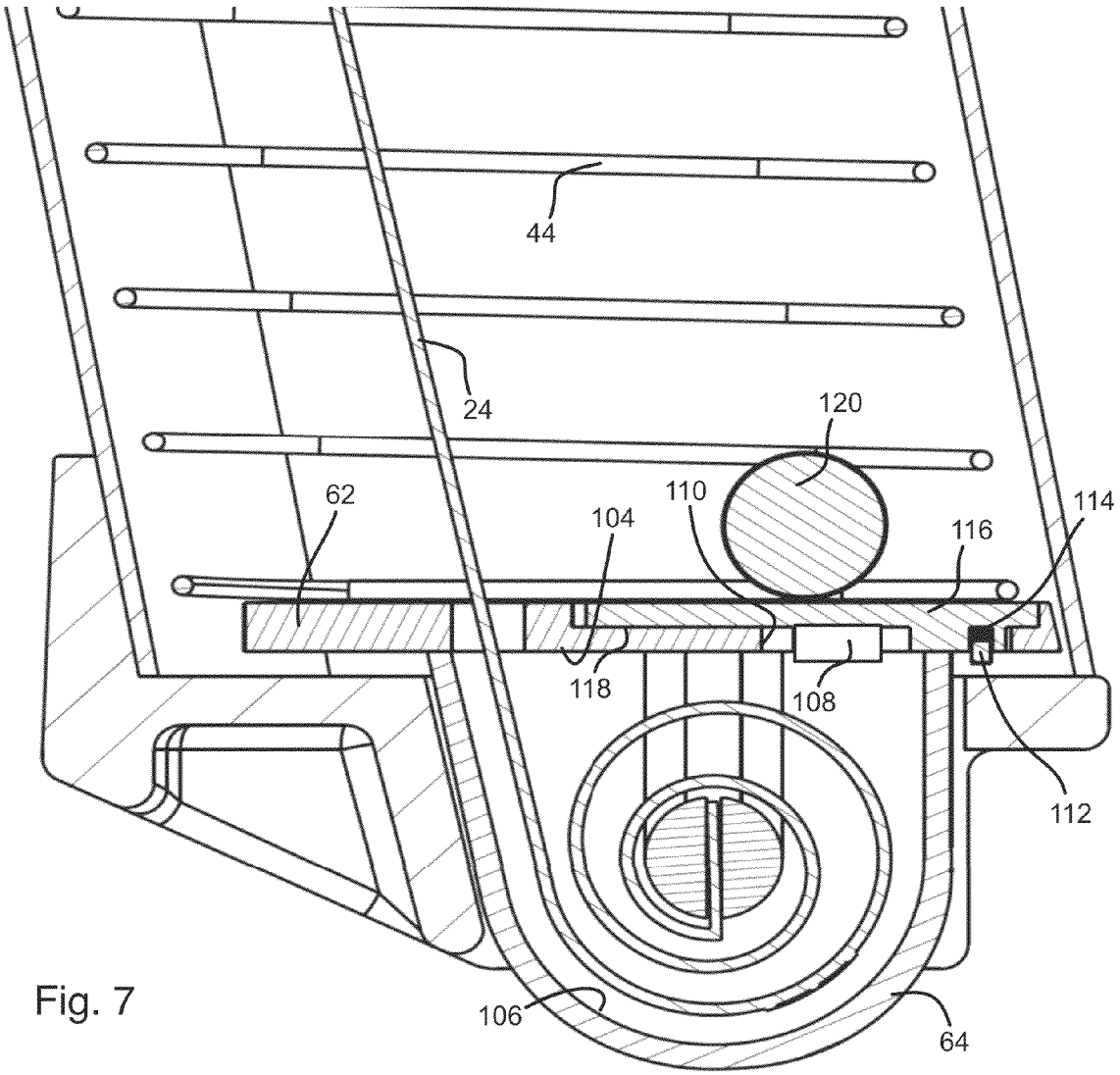
FIG. 7 is a partial cross-sectional view of another embodiment of a magazine incorporating a switch in accordance with an embodiment of the present invention.
Figure 8:
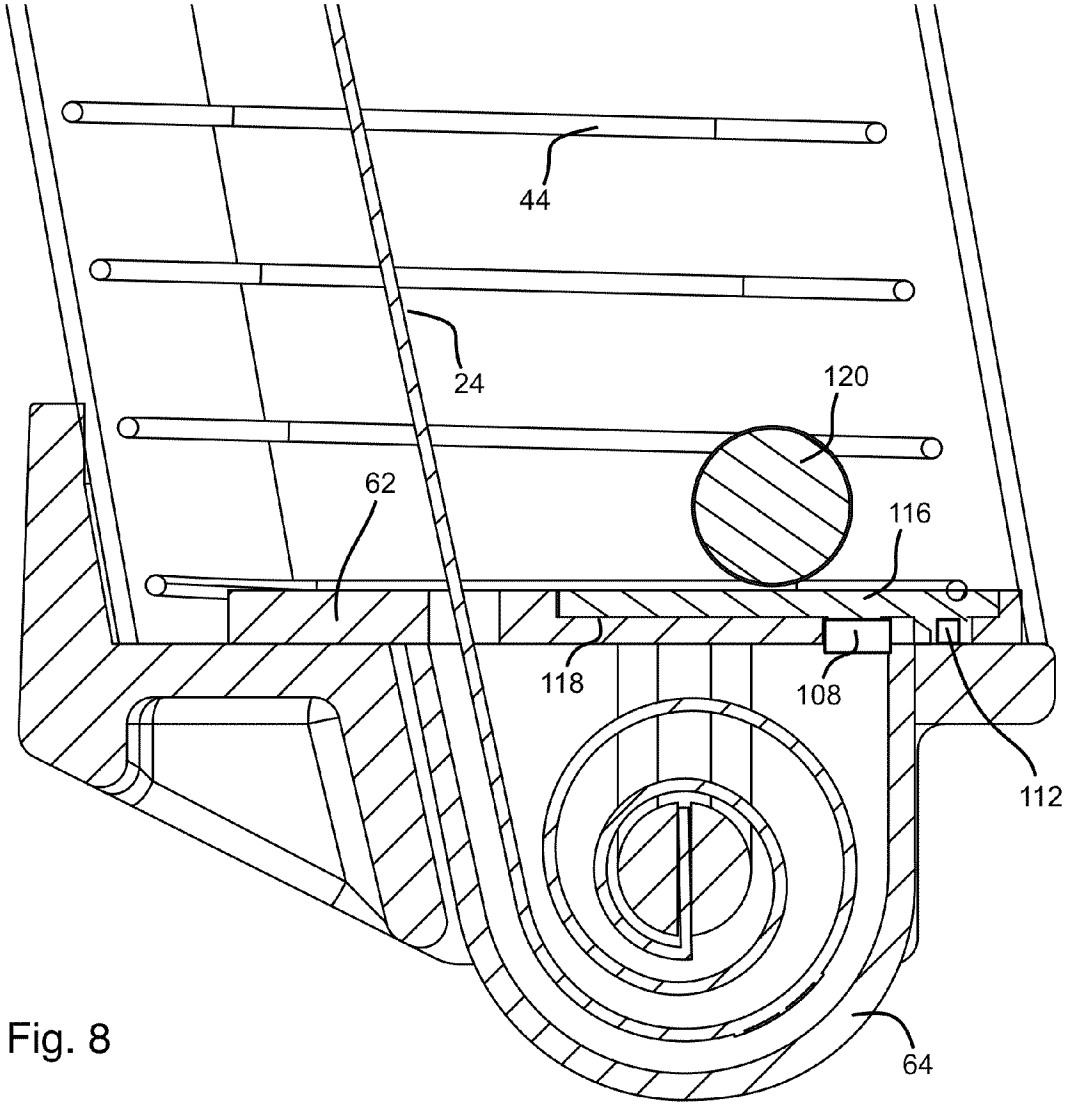
FIG. 8 is a partial cross-sectional view of the embodiment of FIG. 7 having the switch in a closed state in accordance with an embodiment of the present invention.

Referring to FIG. 7, in some embodiments, the upper and lower housing portions 62, 64 define a chamber that is other than drum-shaped. For example, the upper housing portion 62 may define a planar surface 104 and the lower housing portion 64 defines a bell-shaped surface 106 that together define a chamber for winding of the strip 24 around the axle 68 or around a spool 66 mounted to the axle 68.

In some embodiments, a light source 108, such as an LED may illuminate the chamber defined by the upper and lower housing portions 62, 64 to facilitate viewing of the visual indicators 26 on the strip 24. In the illustrated embodiment, the light source 108 protrudes into the chamber through an opening 110 defined by the upper housing portion 62 or emits light through the opening 110.

In some embodiments, the light source 108 may be activated by a switch 112 that is depressed responsive to compression of the follower spring 44. That is to say, the follower spring 44 may press against the switch 112. When the pressure exerted by the follower spring 44 on the switch 112 exceeds a threshold, the switch 112 will change state (e.g. close or open a circuit). When the pressure exerted by the follower spring 44 on the switch 112 is below the threshold, the switch may again change state (e.g. open or close a circuit). The switch 112 may include a biasing member 114 that determines this threshold, i.e. provides a resistance force that must be overcome to depress the switch and change its state.

In the illustrated embodiment, printed circuit board 116 ("PCB 116") has the switch 112 mounted thereto such that the PCB 116 is positioned between the switch 112 and the follower spring 44. Force exerted by the follower spring 44 on the PCB 116 urges the switch 112 against a portion of one or more of the upper housing portion 62, lower housing portion 64, and the cap 18 in order to change the state of the switch 112. In the illustrated embodiment, the upper housing portion 62 defines a seat 118 in which the PCB 116 is positioned. The light source 108 and switch 118 may both protrude through the opening 110 and the switch 112 may engage a portion of the cap 18.

The PCB 116 may have circuits and electronic components mounted thereon to drive the light source 108 responsive to changing of the state of the switch 112. A battery 120 may be electrically coupled to the PCB 116 for powering the PCB 116 and light source 108. In some embodiments, the PCB 116 includes electronic components that detect closing of the switch 112 and, in response, activate the light source 108. The PCB 116 may include a timer and include electronic components that deactivate the light source 108 upon expiration of a time period following closing of the switch 112. The electronic components of the PCB 116 may further deactivate the light source 108 upon detecting opening of the switch 112.

In use, a user may turn on the light source 108 by pushing up on the lower housing portion 64 thereby pushing the PCB 116 and switch 112 upward and allowing the switch 112 to return to an open state. Upon releasing the lower housing portion 64, the follower spring 44 again urges the switch 112 into a closed state, prompting the PCB 116 to turn on the light source 108, which may include starting a timer or counter such that the PCB 116 turns off the light source 108 after expiration of a time period as determined by the timer or counter. In some embodiments, the circuits of the PCB 116 may detect opening and closing the switch 112 and in response turn the light source 108 off if the light source 108 was on at the time of detecting opening and/or closing of the switch 112.

In some embodiments, compression of the switch 112 due to biasing force of the follower spring 44 may cause the switch 112 to go to an open state and decompression of the switch 112 due to an upward force on the lower housing portion 64 causes the switch 112 to go to a closed state. In such embodiments, the PCB 116 may include circuits that detect the momentary changing of the switch 112 to a closed state and, in response, cause the light source 108 to turn on if it was previously off, turn off if it was previously on, or take some other action with respect to the supply of power to the light source 108.

In some embodiments, the light source 108 may be embodied as an ultraviolet (UV) light source and the ink used to print the visual indicators 26, or a treatment on the surface of the strip 24 around the visual indicators 26, may glow responsive to this light in order to enhance visibility of the visual indicators 26. The spool 66 may also include or be treated or coated with a material that glows responsive to UV light to further enhance visibility of the visual indicators 26. The visual indicators 26 may also have reflective treatments to enhance their visibility responsive to light from the light source 108, UV, visible, or otherwise.

Figure 10:
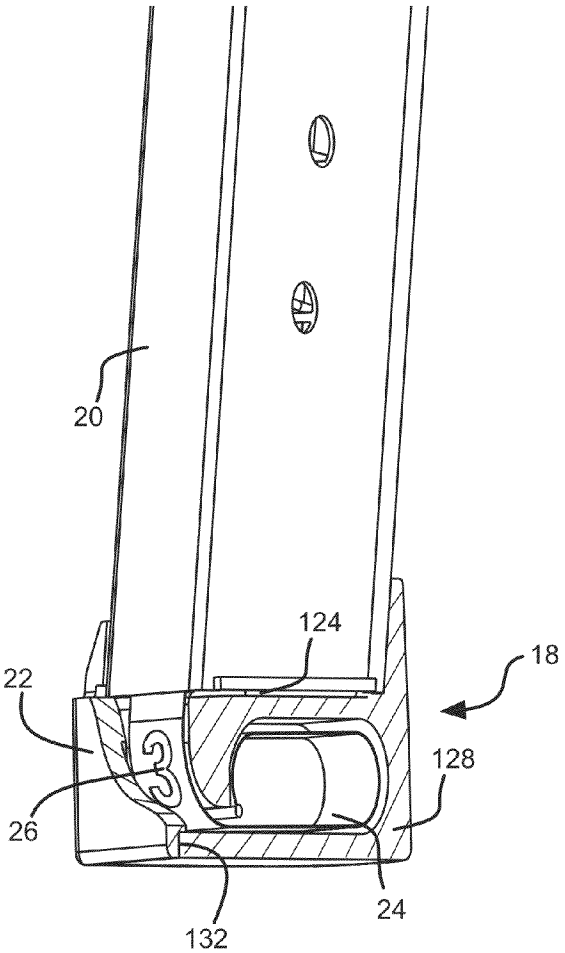
FIG. 10 is an isometric view of the magazine of FIG. 9.
Figure 9:
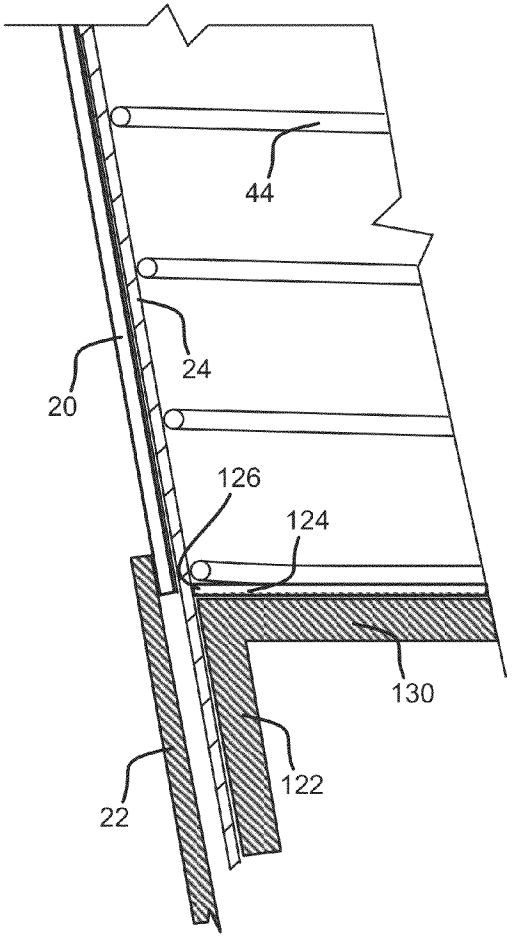
FIG. 9 is a side cross-sectional view of yet another embodiment of a magazine in accordance with an embodiment of the present invention.

Referring to FIGS. 9 and 10, in some embodiments, the strip 24 may extend between the follower spring 44 and a wall of the storage tube 20. In this manner, buckling of the of the strip 24 is prevented. Accordingly, the strip 24 may not be embodied as a constant force spring since the movement of the follower 38 can push the strip 24. The strip 24 may have a concave cross section such that it has further rigidity to resist buckling during pushing of the strip 24. The cap 18 may have a window 22 and guide 122 positioned opposite the window 22 such that the strip 24 is pushed between the window 22 and guide 122 in order to display a number, or other visual indicator, on the strip 24 that is positioned in front of the window 22.

In the illustrated embodiment, the cap 18 includes a plate 124 that engages the storage tube 20 and defines a slot 126 through which the strip 24 passes out of the storage tube 20 and past the window 22. The slot 126 may be an opening defined in the plate 124 or a gap between the plate 124 and an edge of the storage tube 20. The window 22 may be positioned relative to the slot, such as abutting the lower edge of the storage tube 20 or otherwise positioned over the strip 24 as it protrudes from the storage tube 20 such that visual indicators on the strip 24 are visible through the window 22.

The cap 18 may further include a cover 128 secured to the plate 124 and contains the portion of the strip 24 extending outwardly from the storage tube 20. In the illustrated embodiment, the cover 128 is a curled or bent piece of metal or other material having an upper portion 130 secured to the plate 124 and curled such that an edge of the 132 of the cover 128 is positioned abutting or overlapping the window 22. The edge 132 of the cover 128 may abut the plate 124 or the storage tube 20 and the window 22 may be defined by an aperture in the cover 128 that may be occupied by a transparent material. As is apparent in FIG. 10, the sides of the cover 128 may be open. However, sides may be secured to the cover 128 either monolithically or by securement by a fastening means.

Figures 11, 12:
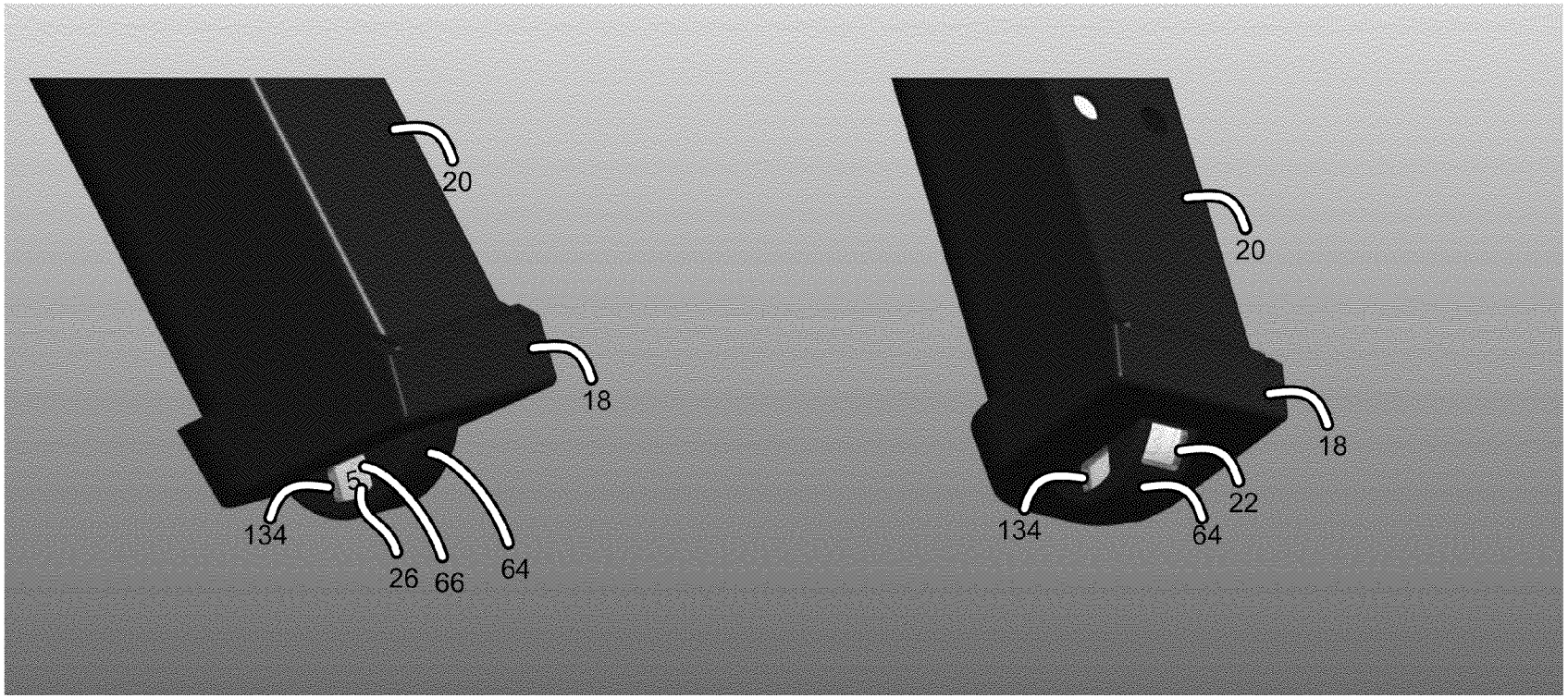
FIGS. 11 and 12 illustrate alternative embodiments of windows for a magazine in accordance with any of the foregoing embodiments.

Referring to FIG. 11, in some embodiments, as noted above, a spool 66 may have visual indicators 26 formed thereon. In some embodiments, the visual indicators 26 may be formed on an axial surface of the spool, e.g. the axis of the spool 66 is normal to the surface on which the visual indicators 26 are formed. Accordingly, a window 134 may be defined in the lower housing portion 64 parallel to the axial surface such that a least one visual indicator 26 printed on the axial surface is visible through the window 134. As shown in FIG. 12, the lower housing portion 64 may include both a window 22 as defined hereinabove and a side window 134.

While the preferred embodiments of the invention have been illustrated and described, as noted above, many changes can be made without departing from the spirit and scope of the invention. For example, although the illustrated magazine is a box type magazine, the strip 24 may be coupled to a follower of tubular type magazine and the spool 66 and/or axle 68 may be mounted to the tubular magazine such that the strip 24 may be taken up or unwound responsive to movement of the follower. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A magazine comprising:

a storage tube defining a proximal end defining a dispensing opening and a distal end;

a biasing member positioned within the storage tube and having a first end portion and a second end portion, the first end portion being positioned closer to the proximal end then the second end portion;

a spool mounted to the storage tube having the biasing member positioned between the proximal end and the spool;

a strip affixed at one end at a first end thereof to the first end portion and secured at a second end thereof to the spool, the strip including visible position indicators defined along the length thereof; and a window positioned over at least a portion of the spool such that one or more of the visible position indicators of the strip are visible through window when at least a portion of the strip is wound around the spool.

2. The magazine of claim 1, wherein the strip includes an elastic material having a rolled-up shape absent forces exerted on the strip.

3. The magazine of claim 1, further comprising a return spring having one end affixed to the spool and the other end fixed relative to the storage tube, the return spring effective to urge the spool to wind the strip further around the spool.

4. The magazine of claim 1, wherein the window has an arcuate shape and protrudes from the distal end of the storage tube, the spool being partially encircled by the arcuate window.

5. The magazine of claim 1, wherein the plurality of visible position indicators are numbers, each number indicating a number of items positioned within the storage tube when the number is visible in the window.

6. The magazine of claim 1, further comprising a cap covering the distal end of the storage tube, the spool being rotatably mounted to the cap.

7. The magazine of claim 6, further comprising:

a printed circuit board interposed between the biasing member and the cap;

a switch mounted on the printed circuit board;

a battery mounted to the printed circuit board;

a light emitting device mounted to the printed circuit board;

wherein the printed circuit board is oriented such that pressure exerted on the printed circuit board causes depression of the switch;

wherein the printed circuit board includes circuits effective to coupled the light emitting device to the battery responsive to depression of the switch.

8. A method for operating a firearm comprising:

providing a storage tube defining a proximal end defining a dispensing opening and a distal end;

providing a biasing member positioned within the storage tube and having a first end portion and a second end portion, the first end portion being positioned closer to the proximal end then the second end portion;

providing a follower slidably positioned within the storage tube between the first end portion of the biasing member and the dispensing opening;

providing a cap configured to slidably secure over the distal end of the storage tube;

providing a spool rotatably mounted within the cap;

providing a strip having a first end and a second end, a clip being secured to the first end and the second end thereof secured to the spool, the strip including a plurality of visible position indicators defined along the length thereof;

interposing the clip between the first end portion of the biasing member and the follower;

slidably securing the cap to the distal end of the storage tube;

providing a window mounted to the cap and positioned over at least a portion of the spool such that one or more of the visible position indicators of the strip are visible through window when at least a portion of the strip is wound around the spool;

loading a plurality of rounds into the storage tube effective to compress the biasing member and permit the strip to wind around the spool; and inserting the storage tube into a firearm having the window visible outside of the firearm.

9. The method of claim 8, further comprising:

cocking the firearm effective to move a round from the storage tube and into a chamber of the firearm;

decompressing the biasing member responsive to removal of the round from the storage tube; and unwinding the strip from the spool responsive to decompressing of the biasing member such that a visible position indicator of the plurality of visible position indicators visible through the window indicates a number of rounds remaining in the storage tube.

10. The method of claim 7, wherein loading the plurality of rounds into the storage tube effective to compress the biasing member further comprises urging the biasing member against a switch effective to change a state of the switch and couple a light source to a power source, the light source positioned to illuminate a portion of the strip viewable through the window.

11. A magazine comprising:

a storage tube defining a proximal end defining a dispensing opening and a distal end;

a follower spring positioned within the storage tube and having a first end portion and a second end portion, the first end portion being positioned closer to the proximal end then the second end portion;

a follower positioned over the first end portion;

a clip positioned between the follower and the first end portion;

a cap slidably secured to the distal end of the storage tube;

a spool mounted to the cap;

a strip affixed at one end at a first end thereof to the clip and secured at a second end thereof to the spool, visual position indicators being formed on one of the strip and a surface of the spool;

a return spring having one end secured to the spool and the other end secured to the cap, the return spring effective to urge the spool to wind the strip further around the spool; and a window positioned over the spool such that one or more of the visual position indicators are visible.

12. The magazine of claim 11, wherein the clip further comprises:

a first flange secured to the strip;

a second flange opposite the first flange having a portion of the biasing member positioned between the first and second flanges.

13. The magazine of claim 12, wherein the second flange is hooked and a portion of the biasing spring is partially encircled by the second flange.

14. The magazine of claim 11, wherein:

wherein the visual indicators are formed on the strip; and wherein the window is an arcuate window extending over a circumferential surface of the spool.

15. The magazine of claim 11, wherein:

wherein the visual indicators are formed on an axial surface of the spool; and wherein the window is positioned over a portion of the axial surface of the spool.

16. The magazine of claim 11, further comprising a housing defining a cavity, the spool being positioned within the cavity, the cap defining an opening having the housing positioned within the opening, the window being formed on a portion of the housing protruding outwardly from the cap and the storage tube.

17. The magazine of claim 16, wherein the housing defines a flange positioned between the cap and the biasing member such that the biasing member urges the housing to remain positioned within the opening.

18. The magazine of claim 17, further comprising a light source positioned to illuminate a portion of the spool visible through the window.

19. The magazine of claim 18, further comprising:

a switch positioned between the flange and the housing; and a power source; and a controller coupled to the switch, light source, and power source and programmed to change a state of the light source between on and off states responsive to actuation of the switch upon urging the housing inwardly toward the storage tube.

20. The magazine of claim 11, wherein the storage tube defines a pair of opposing flanges and the cap defines grooves sized to slidably receive the flanges.

* * * * *